United States Patent [19]

Nishiki et al.

[11] Patent Number: 5,035,779

[45] Date of Patent: Jul. 30, 1991

[54] PROCESS FOR PRODUCING CATHODE AND PROCESS FOR ELECTROLYSIS USING SAID CATHODE

[75] Inventors: Yoshinori Nishiki, Fujisawa; Shuji Nakamatsu, Yokohama; Takayuki Shimamune, Machida, all of Japan

[73] Assignee: Permelec Electrode Ltd., Kanagawa, Japan

[21] Appl. No.: 440,835

[22] Filed: Nov. 24, 1989

Related U.S. Application Data

[62] Division of Ser. No. 213,047, Jun. 29, 1980, Pat. No. 4,900,419.

[30] Foreign Application Priority Data

Jun. 29, 1987 [JP] Japan ..... 62-1596585
Jul. 17, 1987 [JP] Japan ..... 62-177086

[51] Int. Cl.[5] ..... C25B 1/16

[52] U.S. Cl. ..... 204/98; 204/128; 204/290 R

[58] Field of Search ..... 204/98, 128, 129, 38, 204/5, 290 R, 291, 292; 427/77, 123, 125, 125.3, 126.5, 405, 419.3, 419.2, 383.7, 226, 229

[56] References Cited

U.S. PATENT DOCUMENTS

| | | | |
|---|---|---|---|
| 4,248,906 | 2/1981 | Saito et al. | 427/125 |
| 4,427,502 | 1/1984 | Abys | 204/47 |
| 4,450,187 | 5/1984 | Gestaut | 427/125 |
| 4,543,265 | 9/1985 | Kasuya | 204/56.1 |

FOREIGN PATENT DOCUMENTS

| | | | |
|---|---|---|---|
| 0219802 | 3/1985 | Fed. Rep. of Germany | 427/419.2 |

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

A cathode for electrolysis, particularly of a sodium chloride aqueous solution by an ion-exchange membrane method, and a process for producing the same, the cathode comprising a conductive base having a nickel surface and having provided thereon (a) at least one platinum group component selected from the group consisting of a platinum group metal, a platinum group metal oxide, and a platinum group metal hydroxide, and (b) at least one cerium component selected from the group consisting of cerium, cerium oxide, and cerium hydroxide, retaining a markedly reduced hydrogen overpotential for an extended period of time and exhibiting excellent resistance to impurities in the electrolytic solution.

12 Claims, No Drawings

PROCESS FOR PRODUCING CATHODE AND PROCESS FOR ELECTROLYSIS USING SAID CATHODE

This is a divisional of Application No. 07/213,047 filed June 29, 1988 now U.S. Pat. No. 4,900,419.

FIELD OF THE INVENTION

This invention relates to a cathode for electrolysis and a process for producing the same. More particularly, it relates to an activated cathode retaining a low hydrogen overpotential over a long period of time, which can be used suitably for electrolysis of a sodium chloride aqueous solution according to an ion-exchange membrane method.

BACKGROUND OF THE INVENTION

In the electrolytic industry, reduction of energy consumption is an important concern. Great efforts have been made, particularly, to reduce electrolytic voltage.

For example, in the electrolysis of a sodium chloride aqueous solution by an ion-exchange membrane method, improvements in factors causing an increase of voltage have been made as far as are technically possible to accomplish a reduction of voltage by, for example, adoption of an insoluble metallic anode having a coating containing a noble metal oxide, reduction of the electrode gap to a minimum, forced circulation of the electrolytic solution, or like technique. Similarly, various improvements with reference to reduction of overpotential of a cathode have been proposed. However, a cathode which is so durable as an anode and also retains a small magnitude of overpotential of several tens of millivolts over an extended period of time has not yet been developed.

Low-carbon steel, which had been used as a cathode material from the beginning of practical application of the ion-exchange membrane method, exhibits a relatively high hydrogen overpotential ranging from 300 to 400 mV. With the demand for the production of more highly concentrated sodium hydroxide, the low-carbon steel had been replaced with more anticorrosive stainless steel, nickel or a nickel-plated material. Reduction of hydrogen overpotential, however, could not be attained with these materials.

It was then found that the apparent overpotential can be decreased by 100 to 200 mV by increasing the surface area of the cathode by, for example, elution of Zn from an Ni-Zn alloy plating, plasma spray coating of Ni or Raney nickel, or suspension plating using a powderous material. However, the degree of reduction of voltage attained by these techniques is still insufficient. In addition, since the resulting cathode has a rough surface, it tends not only to damage an ion-exchange membrane but to accumulate iron ion, etc., in the electrolytic solution to have reduced activity which leads to a reduction of working life.

In recent years, cathodes comprising nickel as a main component combined with various catalytic components for the purpose of attaining a low overpotential have been widely used. For example, cathodes containing a copper or sulfur component as a catalytic component are known. However, since these components have insufficient durability, the cathode tends to deteriorate and fails to have a long life, though showing a reduced initial overpotential.

It is also known to use a platinum group metal or its oxide in a cathode so as to achieve a reduction of overpotential and extend durability. Examples of known cathodes using an oxide of a platinum group metal include one obtained by coating a heated metal base with a solution containing a salt of a platinum group metal followed by calcining to form a surface layer comprising a metal oxide, e.g., ruthenium oxide, as disclosed in Japanese Patent Publication No. 22556/80; one obtained by depositing a powderous oxide of ruthenium, etc., together with nickel onto a base surface by suspension plating, as disclosed in U.S. Pat. Nos. 4,465,580 and 4,238,311; one obtained by forming a composite oxide of nickel, etc., and ruthenium, etc., on the surface of a base as disclosed in Japanese Patent Application (OPI) No. 232284/84 (the term "OPI" as used herein refers to a "published unexamined Japanese patent application"); and the like. Although these cathodes have a low hydrogen overpotential and are hardly affected by impurities, such as iron in the electrolytic solution, the problem of durability still remains with the use of a labile metal oxide as a cathode, often resulting in short duration.

On the other hand, Japanese Patent Application (OPI) No. 23083/82 discloses a cathode comprising a base, e.g., nickel, on which a platinum group metal, particularly, platinum or an alloy thereof, is chemically deposited. This cathode exhibits a low hydrogen overpotential and durability but is still disadvantageous in that it is subject to deactivation due to impurities, such as iron in the electrolytic solution.

As described above, platinum group metals and oxides thereof are known to have a low hydrogen overpotential. In particular, metallic platinum exhibits excellent durability as a cathode. However, a cathode coated with platinum is so sensitive to impurities, particularly, iron ion in the electrolytic solution, that its activity would be lost due to even a trace amount, e.g., 1 ppm or less, of such impurities. In the actual electrolysis operation, materials of the electrolytic apparatus or pipes often contain iron, and it is very difficult to exclude iron ion from the electrolytic solution.

SUMMARY OF THE INVENTION

Accordingly, one object of this invention is to provide a cathode for electrolysis which maintains an extremely low hydrogen overpotential, exhibits excellent durability, and is hardly affected by impurities in the electrolytic solution.

Extensive studies have been conducted to solve the above-described problems associated with the conventional cathodes for electrolysis. As a result, it has now been found that the above object can be accomplished by a cathode comprising a conductive nickel base having provided thereon at least one platinum group metal component selected from the group consisting of a platinum group metal, a platinum group metal oxide, and a platinum group metal hydroxide (hereinafter simply referred to as a platinum group component) and at least one cerium component selected from the group consisting of cerium, cerium oxide, and cerium hydroxide (hereinafter simply referred to as a cerium component), said platinum group component and cerium component being present either in the same layer or in separate layers with the former in the first layer and the latter in the second layer. The present invention has been completed based on this finding.

The present invention thus provides a cathode for electrolysis comprising a conductive base having a nickel surface having provided thereon a coating layer comprising (a) at least one platinum group component selected from the group consisting of a platinum group metal, a platinum group metal oxide, and a platinum metal hydroxide and (b) at least one cerium component selected from the group consisting of cerium, cerium oxide, and cerium hydroxide; and to a process for producing the same which comprises applying a solution or suspension containing (1) a platinum group metal salt, particles of a platinum group metal or a compound thereof, or a mixture thereof and (2) a cerium salt, particles of cerium or a compound thereof, or a mixture thereof onto a conductive base having a nickel surface to form a coating layer comprising (a) at least one platinum group component and (b) at least one cerium component.

This invention further relates to a cathode for electrolysis which comprises a conductive base having a nickel surface having provided thereon (i) a first coating layer comprising at least one platinum group component selected from the group consisting of a platinum group metal, a platinum group metal oxide, and a platinum group metal hydroxide and further provided thereon (ii) a second coating layer comprising at least one cerium component selected from the group consisting of cerium, cerium oxide, and cerium hydroxide; and to a process for producing the same which comprises applying a solution or suspension containing a platinum group metal salt or particles of a platinum group metal or a compound thereof onto a conductive base having a nickel surface to form a first coating layer containing at least one platinum group component, and then applying a solution or suspension containing a cerium salt or particles of cerium or a compound thereof onto said first coating layer to form a second coating layer containing at least one cerium component.

DETAILED DESCRIPTION OF THE INVENTION

Rare earth elements such as cerium are, in general, chemically active so that they hardly exist in a sodium hydroxide aqueous solution in a stable state. Further, the presence of cerium in a coating layer, even in the form of a mixture, tends to cause an increase of resistance of the coating layer, which may deteriorate overpotential characteristics. For these reasons, it has been considered impossible to use cerium as a cathode component. According to this invention, however, it has been found that the above-mentioned problems can be completely eliminated by incorporating the cerium component into a coating layer in the form of a mixture with the platinum group component or separately incorporating the cerium component into a thin coating layer which is provided on a coating layer containing the platinum group component, thus providing a low hydrogen overpotential cathode with a coating in which the cerium component can stably exist even in high concentration alkali while exhibiting excellent durability and resistance to impurities as well as satisfactory conductivity.

The reason for the above has not yet been elucidated, but it is assumed that the cerium component in the coating forms sparingly soluble cerium hydroxide in high concentration alkali and, at the same time, increases the overpotential of electrochemical deposition of iron onto the platinum group component.

The conductive base which can be used in the present invention includes nickel and a metal having a nickel surface. The metal having a nickel surface preferably includes nickel-plated SUS or steel. Care should be taken not to expose an iron component on the surface of a base because an iron component may be dissolved out on electrolysis at a low overpotential, resulting in reduction in the life of the cathode.

The conductive base having nickel on at least its surface may have any shape, such as plate, rod, porous and expanded mesh shapes. It is preferable to subject the base to be coated to a cleaning treatment or surface roughening treatment, such as degreasing, acid washing, blasting, etc., thereby to improve adhesion between the base and the coating layer.

According to a first embodiment of the present invention, a coating layer containing both a cerium component and a platinum group component is provided on the conductive base.

The platinum group component to be incorporated into the coating layer includes platinum group metals, i.e., platinum, iridium, ruthenium, phodium, palladium and osmium, the oxides and hydroxides of these metals, and mixtures thereof. The proportion of the cerium component to the platinum group component in the coating layer can be selected from a broad range without any particular limitation. Usually, the cerium component is present in an amount of from 5 to 95%, preferably from 30 to 70%, on a metal mol basis, based on the platinum group metal.

The manner of forming a coating layer on the base is not particularly restricted, and various methods can be employed as follows.

One method comprises applying a solution containing a heat-decomposable salt of each of platinum group metal and cerium at a desired ratio onto the surface of a base by coating or a like technique, followed by heat decomposition to form a coating layer. More specifically, a salt of a platinum group metal or cerium (e.g., a chloride thereof, chloroplatinic acid, ruthenium nitrate, and cerium nitrate) is dissolved in water, an alcohol (e.g., isopropyl alcohol and ethanol), an acid (e.g., nitric acid and hydrochloric acid), etc., to prepare a solution containing 2 to 40 g/liter of a platinum group metal or 1 to 100 g/liter of cerium, respectively. The two solutions are mixed at a desired ratio, and the resulting coating composition is applied to a base. After drying, the composition is heated at a temperature of from 300° to 800° C. Heating may be carried out in any of oxidative, inert and reductive atmospheres. In cases of forming a coating layer mainly comprising oxides, the heating is preferably effected in an oxidative atmosphere such as air.

The thus-formed coating layer contains the platinum group metal and/or an oxide or hydroxide thereof and cerium and/or an oxide or hydroxide thereof. In some cases, the resulting coating layer has low crystallinity approximate that of an amorphous form but is not so different in performance from a highly crystalline coating film.

As a modification of the above-described method, a part of the metallic component may be used in the form of solid particles generally having a particle size of from about 0.1 to 50 μm or colloid particles. That is, particles of the platinum group metal, e.g., platinum, ruthenium, iridium, etc., or cerium or an oxide or hydroxide thereof, are dispersed in the above-prepared coating solution to prepare a suspension or a colloidal solution.

The suspension or colloidal solution is adhered to the base, followed by heat treatment in the same manner as described above to form a coating layer.

Another method for forming a coating layer on a base comprises applying a solution or suspension containing a salt of the platinum group metal and a salt of cerium onto the base by dipping, etc., and chemically precipitating the metallic components from the solution or suspension to form a coating layer. For example, a mixed aqueous solution containing chlorides of a platinum group metal and cerium is prepared and adjusted to a pH of from 7 to 14 by addition of an alkali, immersing the base in the mixed solution, and chemically depositing a mixed coating layer on the surface of the base. Since cerium or an oxide thereof is converted to cerium hydroxide in highly concentrated sodium hydroxide during electrolysis, this method is advantageous in that cerium can be formulated in the form of its stable hydroxide from the beginning of the coating process.

The thus-formed coating layer may be calcined at a temperature of from about 300° to about 800° C. to improve stability.

A still another method comprises chemically substituting nickel on the surface of a base with a metallic component, particularly a platinum group metal, of the coating composition, as described in Japanese Patent Application (OPI) No. 23083/82. For example, a solution of a platinum group metal chloride having suspended therein fine particles of metallic cerium or a hydroxide thereof is contacted with a base, and the suspension is adjusted to a pH of from about 0 to about 4 by addition of hydrochloric acid thereby to chemically substitute nickel on the base surface with a platinum group metal ion due to the difference in ionization tendency and, at the same time, to incorporate solid particles of the cerium component into the system to form a desired coating layer on the base surface.

In a second embodiment of the present invention, a first coating layer containing the platinum group component is formed on a conductive base, and then a second coating layer containing the cerium component is formed on the first coating layer.

The platinum group component to be incorporated into the first coating layer includes platinum group metals, i.e., platinum, iridium, ruthenium, phodium, palladium and osmium, the oxides and hydroxides of these metals, and mixtures thereof, and any of them is effective as an active cathode coating The first coating layer preferably has a platinum group metal coverage of about 0.5 g/m$^2$ or more as a metal basis. Since a high coverage is uneconomical, the upper limit is usually about 20 g/m$^2$ from an economic standpoint. The first layer may further contain other corrosion resistant and low overpotential substances, such as nickel.

The cerium component to be used as the second coating layer includes metallic cerium, an oxide or hydroxide thereof, and mixtures thereof. It is preferable that the second coating layer be formed by dipping or coating to such a small coverage so that the first coating layer is not completely covered. Such a coverage is preferably 0.5 g/m$^2$ or more on a cerium basis. Since too high a coverage deteriorates cathode activity, the upper limit of the cerium coverage is desirably 10 g/m$^2$. The second coating layer may further contain analogous components, such as lanthanum.

The manner for forming the first and second coating layers on a base is not particularly restricted, and various methods can be employed as follows.

One method comprises applying a solution containing a heat-decomposable salt of the metal in a desired concentration onto the base by coating or a like technique, and the coating solution is then decomposed by heating to form a coating layer. This method can be applied to either of the first and second coating layers. More specifically, a salt, e.g., a chloride, of the platinum group metal or cerium is dissolved in water, an alcohol, an acid, etc., to prepare a coating solution containing from 2 to 40 g/liter of the platinum group metal or from 1 to 100 g/liter of cerium. The coating solution is adhered to the base, dried, and heated at a temperature of from about 300° to about 800° C. Heating may be effected in any of oxidative, inert and reductive atmospheres. In forming a layer mainly comprising a metal oxide, the heating can be performed in an oxidative atmosphere, such as air.

The thus-formed first coating layer contains the platinum group metal and/or an oxide or hydroxide thereof, while the second coating layer contains cerium and/or an oxide or hydroxide thereof. In some cases, the resulting coating layer has a low crystallinity approximate that of an amorphous form but is not so different in performance from a highly crystalline coating film.

In a modification of the above-described method, a part of the metallic component can be used in the form of solid particles or colloid particles. That is, particles of the platinum group metal, e.g., platinum, ruthenium, iridium, etc., or cerium or an oxide or hydroxide thereof are dispersed in the above-prepared coating solution to prepare a suspension or a colloidal solution. The suspension or colloidal solution is adhered to the base, followed by heat treatment in the same manner as described above to form the respective coating layer.

Another method comprises contacting a base with a solution or suspension containing a salt of the platinum group metal or a salt of cerium by dipping, etc., and forming a coating layer by chemical precipitation or plating. This method can be employed to form either of the first and second coating layers. For example, an aqueous solution containing a chloride of a platinum group metal or cerium is prepared and adjusted to a pH of from 7 to 14 by addition of an alkali (e.g., sodium hydroxide and ammonia), dipping a base in the solution, and chemically depositing and accumulating a coating layer on the surface of the base. Since cerium or an oxide thereof is converted to its hydroxide in highly concentrated sodium hydroxide during electrolysis, this method is advantageous in that cerium can be formulated in a stable hydroxide form from the beginning of the coating process.

Chemical plating of the platinum group metal may also be carried out by dipping the base in a coating solution of the platinum group metal salt having dissolved therein an adequate amount of a reducing agent, such as hydrazine.

Each of the thus-formed first and second coating layers can be calcined at a temperature of from about 300° to about 800° C. to improve stability.

A still another method comprises chemically substituting nickel on the surface of a base with the metal component, i.e., the platinum group metal, of the coating composition to form a first coating layer. For example, a solution of a platinum group metal chloride is brought into contact with the base, and the solution is adjusted to a pH of from about 0 to about 4 by addition of hydrochloric acid thereby to chemically substitute nickel on the base surface with a platinum group metal ion due to the difference in ionization tendency to form a first coating layer on the base surface.

It is also possible to form a first coating layer by plating the base with a platinum group metal using conventional electroplating technique.

If necessary, each of the above-described methods for coating may be carried out repeatedly, or these methods may be appropriately combined.

The present invention is now illustrated in greater detail with reference to the following Examples and Comparative Examples, but it should be understood that the present invention is not deemed to be limited thereto. In these examples, all the percents are by weight unless otherwise indicated.

EXAMPLE 1

A nickel expanded mesh (LW: 12.7 mm; SW: 6.4 mm; t: 1 mm) was subjected to steel grit blasting to roughen the surface. After degreasing and washing, the sheet was etched with boiling 20% hydrochloric acid aqueous solution for 10 minutes to prepare a conductive base.

An aqueous solution containing 20 g/liter of chloroplatinic acid hydrate, 30 g/liter of cerium nitrate hydrate, and 50 g/liter of nitric acid was applied on the base with a brush and the base was dried in air at 50° C. for 5 minutes. The coated base was placed in an electric furnace and the coating was calcined at 50° C. for 10 minutes in an air atmosphere, followed by air-cooling.

The above-described coating-calcination-cooling process was repeated to obtain a cathode having a mixed coating layer of a metal and a metal oxide containing 5 g/m$^2$ of platinum and 3.6 g/m$^2$ of cerum.

EXAMPLE 2

An aqueous solution containing 20 g/liter of ruthenium nitrate, 50 g/liter of cerium nitrate hydrate, and 50 g/liter of nitric acid was coated onto the same type of base as used in Example 1, followed by calcining and cooling. The coating-calcination-cooling process was repeated to obtain a cathode having a mixed coating layer containing 5 g/m$^2$ of ruthenium and 7 g/m$^2$ of cerium.

COMPARATIVE EXAMPLE 1

An aqueous solution containing 20 g/liter of chloroplatinic acid hydrate and 50 g/liter of nitric acid was coated on the same type of base as used in Example 1, and then subjected to calcination in the same manner as in Example 1 to obtain a cathode having a coating layer containing 5 g/m$^2$ of platinum.

COMPARATIVE EXAMPLE 2

An aqueous solution containing 20 g/liter of ruthenium nitrate, 35 g/liter of nickel nitrate hydrate, and 50 g/liter of nitric acid was coated on the same type of base as used in Example 1, followed by calcination to obtain a cathode having a mixed oxide coating layer containing 5 g/m$^2$ of ruthenium and 3 g/m$^2$ of nickel.

In order to evaluate the performance of the cathodes obtained in Examples 1 and 2 in comparison with those obtained in Comparative Examples 1 and 2, each cathode was subjected to electrolysis of a sodium chloride aqueous solution under the conditions shown below, and the change in electrode potential with time was determined. The electrode potential was measured by using a standard calomel electrode (SCE) as a reference electrode and converted to an overpotential value. The results obtained are shown in Table 1 below.

Electrolysis Conditions

Anode: Insoluble titanium electrode
Anolyte: 200 g/liter NaCl aqueous solution
Catholyte: 32 to 33% NaOH aqueous solution (Impurity: Fe=0.4 to 0.5 ppm)
Temperature: 90° C.
Current Density: 30 A/dm$^2$
Electrode Gap: 2 mm

TABLE 1

| Electrode | Cathode Overpotential (mV) | | |
|---|---|---|---|
| | 5 Days | 100 Days | 200 Days |
| Example 1 | 90 | 75 | 80 |
| Example 2 | 100 | 100 | 90 |
| Comparative Example 1 | 135 | 180 | 180 |
| Comparative Example 2 | 100 | 230 | 260 |

As is apparent from the results of Table 1, the cathodes of Examples 1 and 2 retain a markedly reduced hydrogen overpotential, i.e., 100 mV or even less, for an extended period of time. To the contrary, although the comparative cathodes show a relatively low overpotential in the initial stage, the overpotential gradually increases with the progress of electrolysis, ultimately reaching 180 to 260 mV on the 200th day.

When the electrolytic cell after running for 200 days was disassembled and the surface condition of the cathode was visually examined, no deposit was observed at all on the cathodes of Examples 1 and 2, whereas the comparative cathodes were found to have a black needle-like deposit on their surface which seemed to be crystals of iron and iron oxides, indicating that the activity of the cathodes had been deteriorated.

EXAMPLE 3

An aqueous solution containing 20 g/liter of chloroplatinic acid hydrate and 30 g/liter of cerium nitrate was adjusted to a pH of 12 with sodium hydroxide. The same type of base as used in Example 1 was dipped in the aqueous solution for 1 hour. As a result, a coating layer containing 5 g/m$^2$ of platinum and 2 g/m$^2$ of cerium was deposited on the base by chemical precipitation.

COMPARATIVE EXAMPLE 3

The procedure of Example 3 was repeated, except the cerium nitrate was not present in the aqueous solution, to obtain a cathode having a coating layer containing 5 g/m$^2$ of platinum.

Each of the cathodes obtained in Example 3 and Comparative Example 3 was used in a single chamber electrolysis of a sodium chloride aqueous solution under the conditions shown below. The overpotentials before and after the electrolysis were measured in a 32% NaOH aqueous solution at a temperature of 90° C. and at a current density of 30 A/dm$^2$. The results obtained are shown in Table 2.

Electrolysis Conditions

Anode: Ni
Electrolyte: 32% NaOH aqueous solution
Temperature: 90° C.

Current Density: 100 A/dm$^2$
Electrolysis Time: 100 hours
Iron Concentration: 1 ppm
Electrode Gap: 30 mm

TABLE 2

| Electrode | Cathode Overpotential (mV) | |
|---|---|---|
| | Before Electrolysis | After Electrolysis |
| Example 3 | 80 | 90 |
| Comparative Example 3 | 80 | 180 |

It can be seen from the results in Table 2 that the cathode according to the present invention retains a low overpotential as exhibited in the initial stage even after use for electrolysis for 100 hours, suffering no change on its surface, clearly proving stable usage over a long period of time. On the other hand, the platinum-coated cathode of Comparative Example 3 suffers great increase of overpotential, and a black needle-like deposit of iron oxides is observed on its surface as the electrolysis proceeds, indicating serious deterioration of the cathode.

EXAMPLE 4

An aqueous solution containing 20 g/liter of chloroplatinic acid hydrate and 50 g/liter of nitric acid was coated on the same base as used in Example 1 with a brush, dried in air at 50° C. for 5 minutes, and then calcined by heating in an electric furnace at 500° C. for 10 minutes in an air atmosphere, followed by air-cooling.

The above-described coating-calcination-cooling process was repeated to finally form a first coating layer containing 15 g/m$^2$ of platinum.

An aqueous solution containing 50 g/liter of cerium nitrate hydrate and 50 g/liter of nitric acid was then coated on the thus formed first coating layer, calcined, and cooled in the same manner as for the first coating layer. The coating-calcination-cooling process was repeated to finally form a second coating layer comprising cerium and cerium oxide to a cerium coverage of 2 g/m$^2$.

COMPARATIVE EXAMPLE 4

An aqueous solution containing 20 g/liter of chloroplatinic acid hydrate and 50 g/liter of nitric acid was coated on the same type of base as used in Example 1 and calcined by heating in the same manner as in Example 1 to prepare a cathode having a coating layer containing 5 g/m$^2$ of platinum.

Each of the cathodes obtained in Example 4 and Comparative Example 4 was evaluated for performances in the same manner as in Example 1. The results obtained are shown in Table 3.

TABLE 3

| Electrode | Cathode Overpotential (mV) | | |
|---|---|---|---|
| | 5 Days | 100 Days | 200 Days |
| Example 4 | 100 | 80 | 80 |
| Comparative Example 4 | 130 | 180 | 180 |

As is apparent from the results in Table 3, the cathode of the present invention retains a markedly reduced hydrogen overpotential, i.e., 100 mV or even less, for an extended period of time. To the contrary, although the comparative cathode shows a relatively low overpotential in the initial stage, the overpotential gradually increases with the progress of electrolysis, ultimately reaching 180 mV on the 200th day.

When the electrolytic cell after running for 200 days was disassembled and the surface condition of the cathode was visually examined, no deposit was observed at all on the cathode of Example 4, whereas the comparative cathode was found to have a black needle-like deposit on its surface which seemed to be crystals of iron and iron oxides, indicating that the activity of the cathode had been reduced.

EXAMPLE 5

The same type of base as used in Example 1 was dipped in an aqueous solution containing 20 g/liter of chloroplatinic acid hydrate and 10 g/liter of hydrochloric acid for 1 hour to form a platinum layer containing 5 g/m$^2$ of platinum.

The base was then dipped in a suspension containing 30 g/liter of cerium nitrate hydrate and 40 g/liter of sodium hydroxide for 1 hour and then dried in air at 50° C. for 1 hour. There was deposited a coating layer of cerium hydroxide and cerium oxide containing 2 g/m$^2$ of cerium by chemical precipitation.

COMPARATIVE EXAMPLE 5

A cathode having a coating layer containing 5 g/m$^2$ of platinum was prepared according to the procedure of Example 5.

Each of the cathodes prepared in Example 5 and Comparative Example 5 was evaluated in the same manner as in Example 3. The results obtained are shown in Table 4 below.

TABLE 4

| Electrode | Cathode Overpotential (mV) | |
|---|---|---|
| | Before Electrolysis | After Electrolysis |
| Example 5 | 90 | 90 |
| Comparative Example 5 | 80 | 180 |

It can be seen from the results in Table 4 that the cathode according to the present invention retains the low overpotential as exhibited in the initial stage even after use for electrolysis for 100 hours, suffering no change on its surface, clearly proving stable use over a long period of time. On the other hand, the platinum-coated cathode of Comparative Example 5 suffers a great increase of overpotential, and a black needle-like deposit of iron oxides is observed on its surface as electrolysis proceeds, indicating serious deterioration of the cathode.

EXAMPLE 6

A metal expanded mesh made of SUS 310S (LW: 12.7 mm; SW: 6.4 mm; t: 1 mm) was subjected to steel grit blasting to roughen its surface. After degreasing and washing, the sheet was washed with boiling 20% aqueous solution of hydrochloric acid for 5 minutes. The thus-treated steel expanded mesh was plated with nickel to a thickness of about 10 μm using a usual Watts bath to prepare a conductive base.

The base was then plated with platinum in a platinum plating bath comprising a 5% hydrochloric acid aqueous solution having dissolved therein 20 g/liter of chloroplatinic acid to a platinum coverage of 10 g per m$^2$ of projected area. The plating was effected at a temperature of 30° C. and at a current density of 1 A/dm$^2$. The platinum-plated base was heated at 350° C. for 10 minutes, followed by cooling.

An aqueous solution containing 50 g/liter of cerium nitrate and 50 g/liter of nitric acid was coated on the platinum-plated base, calcined by heating in an electric furnace at 400° C. for 10 minutes while circulating air, and cooled in air. The coating-calcination-cooling process was repeated four times to finally form a second coating layer comprising cerium and cerium oxide containing 4 g of cerium per $m^2$ of the projected area.

When the resulting cathode was subjected to electrolysis of a sodium chloride aqueous solution under the same conditions as in Example 1, the cathode overpotential measured 100 mV in the initial stage, and its low level was maintained at 110 mV after running for 200 days, proving it to be very stable.

EXAMPLE 7

A ruthenium oxide powder having a particle size of 0.5 to 10 μm (prepared by mixing a ruthenium chloride powder with the equal amount of nitric acid, heating the mixture at 500° C. for 1 hour under aeration, and cooling, followed by pulverization) was suspended in an aqueous solution of nickel chloride having a nickel content of 50 g/liter to prepare a plating bath. The same type of conductive base as used in Example 6 was treated with the plating bath under electroplating conditions of 40° C. and 10 $A/dm^2$ to form a first coating layer mainly comprising Ni and $RuO_2$ and having an apparent thickness of about 10 to 20 μm.

The thus-formed first coating layer had an extremely rough surface and was found to contain ruthenium oxide in an amount corresponding to about 10 g of ruthenium per $m^2$.

On the first coating layer was further provided a second coating layer comprising metallic cerium and lanthanum and oxides thereof as follows. A coating composition comprising 50 g/liter of mixed nitrate hydrate of cerium and lanthanum (3:1 by weight) and 50 g/liter of nitric acid was coated on the first coating layer with a brush. After drying at room temperature, the coating was heated by means of a panel type infrared heater at 400° C. for 15 minutes. This coating-heating process was repeated once more to finally obtain a second coating layer containing 3 $g/m^2$ of metal components as a metal basis.

When the resulting cathode was evaluated in the same manner as in Example 3, the overpotentials before and after the electrolysis were 100 mV and 110 mV, respectively, showing no substantial difference therebetween.

As described above, the cathode in accordance with the present invention in which a platinum group component and a cerium component are coated on a conductive base either simultaneously (i.e., in the same layer) or successively (i.e., in separate layers) retains a markedly reduced hydrogen overpotential and has excellent durability. Therefore, by the use of the cathode of the present invention in electrolysis, energy consumption can be greatly reduced.

Moreover, the cathode of the present invention has excellent resistance to corrosion due to impurities, such as iron in the electrolytic solution, so that it can be used in a stable manner as a cathode for electrolysis of a sodium chloride aqueous solution and the like for an extended period of time.

While the invention has been described in detail and with reference to specific embodiments thereof, it will be apparent to one skilled in the art that various changes and modifications can be made therein without departing from the spirit and scope thereof.

What is claimed is:

1. The process for electrolysis of one or more electrlyte solutions comprising applying an electric potential across an anode electrode and a cathode electrode present in an anolyte and a catholyte respectively, to thereby pass an electric current through one or more electrolyte solutions, wherein the cathode electrode comprises a conductive base having a nickel surface and a coating layer provided thereon, said layer consisting essentially of at least on platinum group component from the group consisting of a platinum group metal, a platinum group metal oxide, and a platinum group metal hydroxide, said platinum group component being present in an amount of from 0.5 to 20 $g/m^2$ on a platinum group metal basis, and (b) at least one cerium component selected from the group consisting of cerium, cerium oxide, and cerium hydroxide, said cerium component being present in an amount of from 0.5 to 10 $g/m^2$ on a cerium basis.

2. A process for electrolysis as in claim 1 wherein said platinum group component and cerium component are present in a single coating layer.

3. A process for electrolysis as in claim 2, wherein said cerium component (b) is present in an amount of from 30 to 70%, on a metal mol basis, based on the platinum group component (a).

4. A process for electrolysis as in claim 2, wherein said platinum group metal is platinum.

5. A process for electrolysis as in claim 2, wherein said platinum group metal oxide is ruthenium oxide.

6. A process for electrolysis as in claim 1, wherein said platinum group component (a) is present in a first coating layer provided on the base and said cerium component (b) is present in a second coating layer provided on said first coating layer.

7. A process for electrolysis as in claim 6, wherein said platinum group metal is platinum.

8. A process for electrolysis as in claim 6, wherein said platinum group metal oxide is ruthenium oxide.

9. A process for electrolysis as in claim 1, wherein the one or more electrolyte solutions is an aqueous sodium chloride solution, said aqueous sodium chloride solution serving as both the anolyte and catholyte.

10. A process for electrolysis as in claim 9, wherein the increase in cathode hydrogen overpotential is less than or equal to 10 mV after electrolysis for 100 hours.

11. A process for electrolysis as in claim 1, wherein the one or more electrolyte solutions comprise an aqueous sodium chloride solution as the anolyte and an aqueous sodium hydroxide solution as the catholyte.

12. A process for electrolysis as in claim 11, wherein the cathode hydrogen overpotential is less than or equal to 100 mV after electrolysis for 200 days.

* * * * *

UNITED STATES PATENT AND TRADEMARK OFFICE

CERTIFICATE OF CORRECTION

PATENT NO. : 5,035,779

DATED : July 30, 1991

INVENTOR(S) : Yoshinori NISHIKI et al

It is certified that error appears in the above-identified patent and that said Letters Patent is hereby corrected as shown below:

In claim 1, column 12, line 18, delete "on" and substitute --one--; and after "component" insert --selected--.

Signed and Sealed this

Fifth Day of January, 1993

*Attest:*

DOUGLAS B. COMER

*Attesting Officer*

*Acting Commissioner of Patents and Trademarks*